US007853028B2

(12) United States Patent
Fischer

(10) Patent No.: US 7,853,028 B2
(45) Date of Patent: Dec. 14, 2010

(54) HEARING AID AND METHOD FOR ITS ADJUSTMENT

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1190 days.

(21) Appl. No.: 11/485,050

(22) Filed: Jul. 11, 2006

(65) Prior Publication Data

US 2007/0009126 A1 Jan. 11, 2007

(30) Foreign Application Priority Data

Jul. 11, 2005 (DE) ..... 10 2005 032 273

(51) Int. Cl.
*H04R 25/00* (2006.01)

(52) U.S. Cl. ..... 381/312

(58) Field of Classification Search ..... 381/312, 381/314, 315

See application file for complete search history.

(56) References Cited

U.S. PATENT DOCUMENTS

| | | | | |
|---|---|---|---|---|
| 4,947,432 | A | | 8/1990 | Topholm |
| 5,202,927 | A | | 4/1993 | Topholm |
| 5,303,306 | A | * | 4/1994 | Brillhart et al. ..... 381/315 |
| 5,710,819 | A | | 1/1998 | Topholm et al. |
| 6,035,050 | A | | 3/2000 | Weinfurtner et al. |
| 6,118,877 | A | | 9/2000 | Lindemann et al. |
| 2004/0213424 | A1 | | 10/2004 | Hamacher et al. |

FOREIGN PATENT DOCUMENTS

| | | | |
|---|---|---|---|
| AU | 58 30898 | A | 3/1998 |
| DE | 3205685 | C2 | 6/1990 |
| DE | 44 27 216 | A1 | 2/1996 |
| EP | 0 710 048 | | 5/1995 |
| EP | 1 432 282 | A2 | 6/2004 |
| WO | WO 97/14267 | | 4/1997 |

* cited by examiner

*Primary Examiner*—Brian Ensey
(74) *Attorney, Agent, or Firm*—Schiff Hardin LLP

(57) ABSTRACT

A hearing aid and appertaining method of adjustment permit adjusting a hearing aid more conveniently and more specifically. For this purpose, parameters for real hearing situations are stored in a storage device in the hearing aid or in the remote control for an adjustment procedure by the hearing aid wearer him- or herself. These hearing examples are then reproduced to the hearing aid wearer for the adjustment procedure. The hearing aid wearer therefore does not have to wait for a corresponding hearing situation in his surrounding area for the adjustment process and can repeat the adjustment process as required.

13 Claims, 1 Drawing Sheet

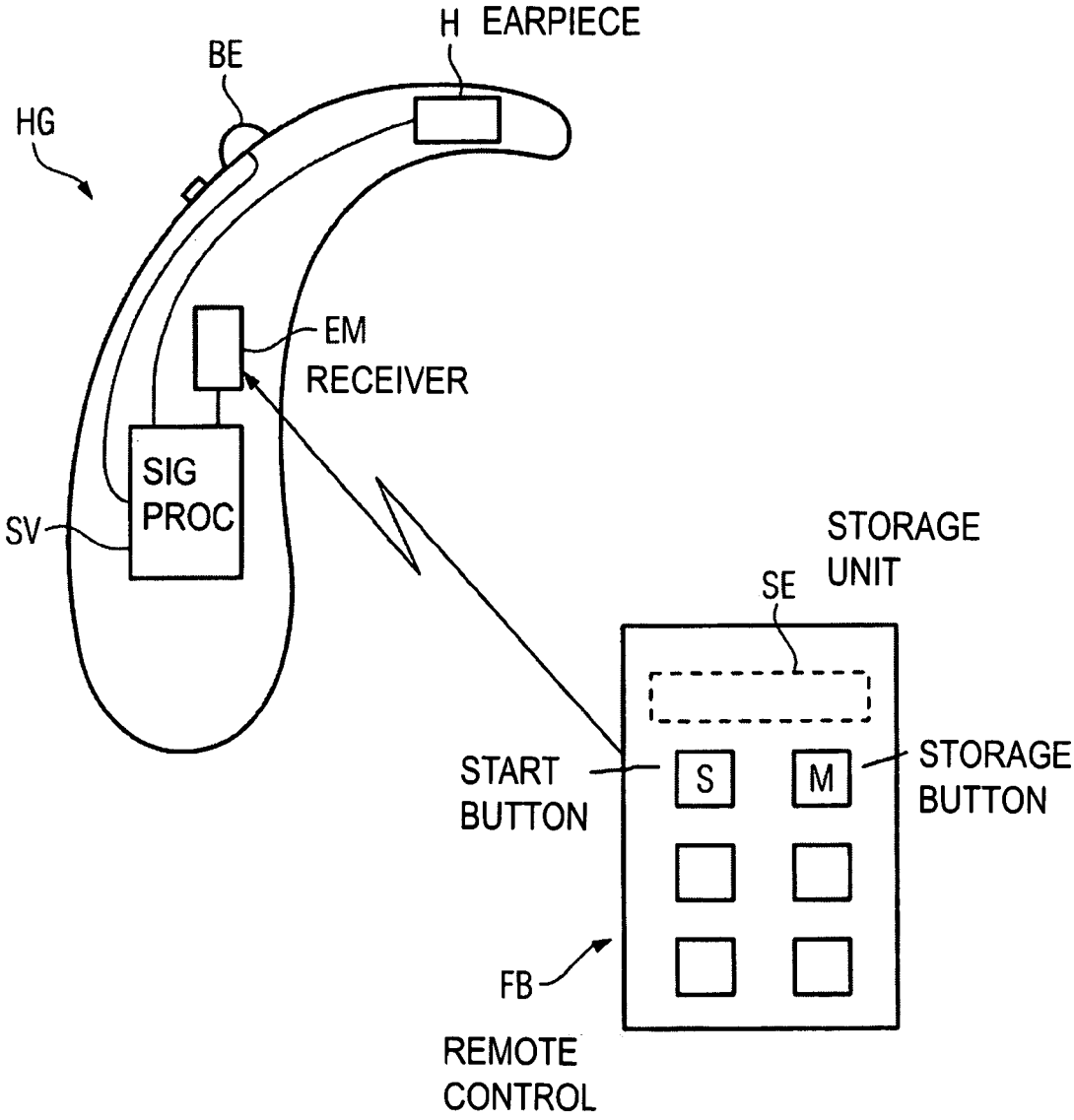
H EARPIECE
BE
HG
EM
RECEIVER
SIG
PROC
SV
STORAGE
UNIT
SE
START
BUTTON
S
M
STORAGE
BUTTON
FB
REMOTE
CONTROL

HEARING AID AND METHOD FOR ITS ADJUSTMENT

BACKGROUND

The present invention relates to a hearing aid having a storage device for storage of signal data, a signal processing device for outputting the signal data from the storage device, and a control device for adjustment of the signal processing device. The present invention furthermore relates to a hearing aid system having a hearing aid, to a remote controller and, finally, to a method for adjustment of the hearing aid.

Until now, it has not been possible for a hearing aid wearer, or has been possible only to a very restricted extent, to adjust the transmission characteristic of his hearing aid as appropriate for his own wishes and requirements, and at any time, that is to say, particularly without having to use the help of an acoustician. The reason for this is due to the range and complexity of the hearing aid parameters, which can be viewed only by appropriately trained specialist personnel. In particular, the hearing aid wearer can often not objectively decide what the hearing situation is in order to allow him to appropriately adjust his hearing aid.

With most hearing aids, the only provision that has been made in the past is for the hearing aid wearer to be able to adjust the volume on his hearing aid himself. The current hearing situation may be defined by a classifier, with the selected volume relating to the current hearing situation being stored.

U.S. Pat. Nos. 5,202,927; 5,710,819; 4,947,432; and 5,303,306 each disclose the transmission of control signals to hearing aids in order to adjust them. In particular, appropriate monitoring parameters can be transmitted from a remote control to the hearing aid.

Furthermore, the German patent document no. DE 44 27 216 A1 describes a method for tinnitus supply, in which an acoustic concealment signal, which has spectral components of the tinnitus signal, is selected or produced, and is offered to the tinnitus patient while the tinnitus is occurring. Natural tonal properties which vary over time are used as the concealment signal.

Furthermore, the Australian patent document no. AU 199858308 A1 and German patent document no. DE 32 05 685 C2 disclose the use of synthetic test signals for adjustment of hearing aids. This allows a hearing aid wearer to carry out conventional tone audiometry himself. All cited references are herein incorporated by reference.

However, these adjustment capabilities have the disadvantage that the natural hearing situations differ from the synthetic test signals, so that the settings can be implemented only approximately.

SUMMARY

The object of the present invention is thus to improve the adjustment capabilities for the hearing aid wearer himself.

According to various embodiments of the invention, this object is achieved by a hearing aid having a storage device for storage of signal data, a signal processing device for outputting the signal data from the storage device, and a control device for adjustment of the signal processing device, in which the signal data comprises test audio data relating to a plurality of classes of characteristic hearing situations, the test audio data in a desired class can at least partially be output via the signal processing device by operation of the control device, the signal processing device can be adjusted while the audio data is being output, and the setting of the signal processing device for the desired class can be stored.

Furthermore, various embodiments of the invention provide a hearing aid system having a hearing aid and a remote control, in which the remote control has a storage device for storage of test audio data relating to a plurality of classes of characteristic hearing situations and for transmission of the test audio data in a desired class to the hearing aid, the hearing aid can be adjusted by the hearing-aid wearer while the test audio data is being replayed, and the setting of the hearing aid for the desired class can be stored in the hearing aid.

Various embodiments of the invention likewise provide a method for adjustment of a hearing aid by storage of test audio data which represents a plurality of classes of characteristic hearing situations, reproduction of the stored test audio data in a desired class by way of the hearing aid to be adjusted, adjustment of the hearing aid on the basis of the reproduced test audio data by the hearing aid wearer in accordance with his individual requirements, and storage of the setting of the hearing aid for the desired class in the hearing aid.

Accordingly, it is thus possible to offer the hearing aid wearer so-called real-life test signals which correspond to a characteristic hearing situation, for adjustment purposes. This allows the hearing aid wearer to carry out the adjustment process more specifically and more accurately. In this case, it is advantageous for a sequence of audio or test signals to comprise signals from all the classifier classes, i.e., the hearing situations which can be distinguished by the hearing aid classifier, in each case at different levels.

Consequently, the hearing aid wearer no longer has to wait, as was normal until now, for, for example, the hearing situation of "quiet music" to occur in his natural environment, thus allowing him for the first time to adjust his hearing aid. In fact, according to embodiments of the invention, he can now carry out the adjustment procedure before entering a natural situation, such as this, whenever he wishes to and this can be done in a reproducible manner. The user can then modify hearing aid parameters as a function of the class and level, using natural hearing situations.

These modifications are then stored in the hearing aid, and are immediately effective. By way of example, the hearing aid wearer can thus select the sound as follows when offered objectively quiet music: more high-tones, reduced mid-tones and more low-tones. The hearing aid is preferably controlled by way of a remote control. This allows the hearing aid wearer to adjust the hearing aid conveniently, using the remote control.

The test audio data advantageously comprises an announcement and a subsequent hearing example. This makes it possible to ensure that the hearing aid wearer correctly assesses and classifies the subsequently reproduced hearing example.

In accordance with one likewise preferred development, the reproduction of the test audio data is repeated until the hearing aid wearer pushes an appropriate control button. The hearing aid wearer can thus spend as long as he desires in adjustment of the hearing aid for specific hearing situations.

The adjustment range of the hearing aid can also be predetermined as a function of reproduced audio data. This is particularly advantageous when the hearing aid wearer incorrectly assesses the audio signals offered and thus, for example, would set the volume too high for the "quiet music" hearing situation.

DESCRIPTION OF THE DRAWING

The present invention will be explained below in more detail with reference to the attached drawings, which is a pictorial block diagram of one hearing aid system according to an embodiment of the invention.

DETAILED DESCRIPTION OF THE PREFERRED EMBODIMENTS

The exemplary embodiment which will be described in more detail in the following text represents one preferred embodiment of the present invention.

Accordingly, the hearing aid wearer can adjust the signal processing of his hearing aid himself by actions on his hearing aid or on a remote control. Primarily, two components are used for this purpose:

1. Test signals which correspond to a real hearing situation, and

2. Control elements on the hearing aid or on the remote control for adjustment of the hearing aid by the hearing aid wearer.

The test signals and hearing examples correspond to all the major environmental situations to which a hearing aid wearer is typically subject. One hearing example, e.g., is thus provided for the hearing situation of a speech in a quiet environment, quiet music, etc., as a test signal. These test signals are stored in a storage unit SE in a remote control FB in accordance with the example illustrated in the FIGURE. The remote control FB may transmit the test signals wirelessly to a hearing aid HG, which has an appropriate receiver EM for this purpose. In one alternative embodiment, the storage unit for storage of the test signals can also be provided directly in the hearing aid.

The receiver EM in the hearing aid HG transmits the received test signals to signal processing SV, which drives an earpiece H. The signal processing SV can be adjusted via a control element BE on the hearing aid HG. It is also possible to adjust the signal processing SV via the remote control FB. For example, appropriate adjustment buttons on the remote control can be used to set "volume"/"treble"/"bass" or else only "volume".

By way of example, the adjustment process can be started by pushing the button S on the remote control FB. The selected setting can be stored by pushing the button M.

An adjustment process is described below in detail in the following text. In this case, a sequence of test signals or hearing examples is advantageously played to the hearing aid wearer, using the hearing aid, as soon as he pushes the start button S on the remote control FB. Each hearing example contained in the sequence is introduced by an announcement. This announcement is, for example: "this is quiet music". The hearing example including the announcement is repeated until the hearing aid wearer pushes a further button or the storage button M. Until then, the hearing aid wearer has the capability to adjust the volume for the specific signal within a predetermined framework as is pleasant for him. The announcement and the restriction to the adjustment capability for the volume are important in order to prevent the hearing aid wearer from accidentally, for example, "turning up" quiet signals to a normal volume.

Once the hearing aid wearer has pushed the further button or storage button M in, the next hearing example, which represents a different hearing situation, is reproduced. The sequence on the hearing examples to be offered may appear as follows:

speech in a quiet environment (normal, quiet, loud)
speech with interference noise (normal, quiet, loud)
traffic noise (normal, quiet, loud)
natural noise (normal, quiet, loud)
music (normal, quiet, loud)
silence (microphone noise)
telephone Once a sequence of hearing examples such as this has been run through, this results in class-dependent and level-dependent modification of the gain and compression parameters in the hearing aid, which can be used by way of example as a preset for more comprehensive learning and training algorithms. The adjustment procedure can be repeated, restarted and terminated prematurely as often as desired.

Furthermore, a "reset" option may be provided, via which the parameters can be reset again to the initial setting set by the acoustician, in order, for example, to cancel incorrect actions which occurred initially.

According to various embodiments of the invention, quasi-real hearing examples are used for the adjustment procedure and can be reproduced at any desired time. In comparison to known methods in which adjustment capabilities are provided only during real, actual hearing situations, this offers the following advantages:

The training procedure according to embodiments of the invention with quasi-real hearing examples is not in the form of a permanent correction to non-optimal settings, which are thus disturbing and tedious, but in the form of a deliberately selected action which the hearing aid wearer can carry out with full concentration, at any time, and in his desired environment.

Since the test signals are reproducible, they are imprinted after a short time, which, of course, is not the case with real signals. The more often the hearing aid wearer runs through the training procedure, the more specifically and reliably he can carry out the desired modification to the sound of his hearing aid.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The term "mechanism" construed broadly and is defined to mean any physical or software implemented entity including combination entities.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various FIGURES presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" "critical". Numerous modifications and adaptations will be readily apparent to those skilled in this art without departing from the spirit and scope of the present invention.

What is claimed is:

1. A hearing aid system comprising:

a hearing aid configured to be worn at an ear of a user;

said hearing aid comprising a signal processor that is selectively configurable to operate with different settings respectively in different hearing environments, an earpiece connected to an output of the signal processor that emits an audible signal to the wearer corresponding to an electrical signal at the output of the signal processor, an externally-accessible hearing aid interface connected to the signal processor and allowing a user to manually select a hearing environment to which said signal processor is then set;

a memory accessible by said signal processor, said memory having a plurality of different audio tone examples stored therein respectively for testing the different hearing environments to which the signal processor is configurable; and said signal processor, upon being set to one of said hearing environments by operation of said hearing aid user interface, being configured to access said memory to retrieve the audio tone example stored therein for the hearing environment to which the signal processor is set, and to cause the audio tone example to be audibly emitted by said earpiece to the user while said user operates said hearing aid interface to adjust the settings of the signal processor for the selected hearing environment.

2. A hearing aid system as claimed in claim 1 comprising a remote unit located externally of and remote from said hearing aid, in which said memory is contained, said remote unit comprising a first communication unit and said hearing aid comprising a second communication unit connected to the signal processor and in remote communication with the first communication unit, and wherein said signal processor is configured to access said memory in said remote unit via said first and second communication units.

3. A hearing aid system as claimed in claim 1 wherein said memory has, for each of said audio tone examples, a stored announcement that verbally describes the hearing environment for which the respective audio tone example is used for testing, and wherein said signal processing unit is configured to, upon retrieving one of said audio tone examples, also retrieve the announcement stored therewith and to play the announcement through the earpiece preceding the audio tone example.

4. A hearing aid system as claimed in claim 3 wherein said signal processor is configured to repeatedly play said announcement followed by said test audio tone example through the earpiece until a predetermined entry is made via said hearing aid user interface.

5. A hearing aid system as claimed in claim 1 wherein said signal processor is configured to be adjusted within a limited adjustment range dependent on the selected hearing environment.

6. A hearing aid system comprising:

a hearing aid configured to be worn at an ear of a user;

said hearing aid comprising a signal processor that is selectively configurable to operate with different settings respectively in different hearing environments, an earpiece connected to an output of the signal processor that emits an audio signal to the wearer corresponding to an electrical signal at the output of the signal processor, and a first communication unit;

a remote control unit comprising a second communication unit in communication with said first communication unit, and an interface allowing a user to communicate, via said first and second communication units, with said signal processor to manually select a hearing environment to which said signal processor is then set;

said remote control unit comprising a memory accessible by said signal processor via said first and second communication units, said memory having a plurality of different audio tone examples stored therein respectively for testing the different hearing environments to which the signal processor is settable; and said signal processor, upon being set to one of said hearing environments by operation of said interface, being configured to access said memory to retrieve the audio tone example stored therein for the hearing environment to which the signal processor is set, and to cause the audio tone example to be audibly emitted by said earpiece to the user while said user operates said interface to adjust the settings of the signal processor for the selected hearing environment.

7. A hearing aid system as claimed in claim 6 wherein said memory has, for each of said audio tone examples, a stored announcement that verbally describes the hearing environment for which the respective audio tone example is used for testing, and wherein said signal processing unit is configured to, upon retrieving one of said audio tone examples, also retrieve the announcement stored therewith and to play the announcement through the earpiece preceding the audio tone example.

8. A hearing aid system as claimed in claim 7 wherein said signal processor is configured to repeatedly play said announcement followed by said test audio tone example through the earpiece until a predetermined entry is made via said hearing aid user interface.

9. A hearing aid system as claimed in claim 6 wherein said signal processor is configured to be adjusted within a limited adjustment range dependent on the selected hearing environment.

10. A method for adjusting a hearing aid configured to be worn at an ear of a user, said hearing aid comprising a signal processor that is selectively configurable to operate with different settings respectively in different hearing environments, an earpiece connected to an output of the signal processor that emits an audio signal to the wearer corresponding to an electrical signal at the output of the signal processor, said method comprising the steps of:

via an interface in communication with the signal processor, manually selecting a hearing environment to which said signal processor is then set;

in a memory accessible by said signal processor, storing a plurality of different audio tone examples stored therein respectively for testing the different hearing environments to which the signal processor is settable; and from said signal processor, upon being set to one of said hearing environments by operation of said hearing aid user interface, accessing said memory and retrieving the audio tone example stored therein for the hearing environment to which the signal processor is set, and causing the audio tone example to be audibly emitted by said earpiece to a user while said user operates said interface to adjust the settings of the signal processor for the selected hearing environment.

11. A method as claimed in claim 10 comprising, in said memory, storing, for each of said audio tone examples, an announcement that verbally describes the hearing environment for which the respective audio tone example is used for testing, and from said signal processing unit, upon retrieving one of said audio tone examples, also retrieving the announcement stored therewith and playing the announcement through the earpiece preceding the audio tone example.

12. A method as claimed in claim 10 comprising from said signal processor, repeatedly playing said announcement followed by said test audio tone example through the earpiece until a predetermined entry is made via said interface.

13. A method as claimed in claim 11 comprising allowing said signal processor to be adjusted only within a limited adjustment range dependent on the selected hearing environment.

* * * * *